US010348030B1

(12) United States Patent
Lin et al.

(10) Patent No.: US 10,348,030 B1
(45) Date of Patent: Jul. 9, 2019

(54) SOCKET CONNECTOR

(71) Applicant: Cheng Uei Precision Industry Co., Ltd., New Taipei (TW)

(72) Inventors: Chih-Chiang Lin, New Taipei (TW); Chun-Fu Lin, New Taipei (TW); Te-Hung Yin, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/985,654

(22) Filed: May 21, 2018

(51) Int. Cl.

| | |
|---|---|
| ***H01R 13/44*** | (2006.01) |
| ***H01R 13/52*** | (2006.01) |
| ***H01R 13/627*** | (2006.01) |
| ***H01R 24/62*** | (2011.01) |
| ***H01R 13/64*** | (2006.01) |
| ***H01R 13/74*** | (2006.01) |

(52) U.S. Cl.
CPC ..... *H01R 13/5202* (2013.01); *H01R 13/627* (2013.01); *H01R 13/64* (2013.01); *H01R 13/745* (2013.01); *H01R 24/62* (2013.01)

(58) Field of Classification Search
CPC ..... H01R 13/44; H01R 13/447; H01R 13/46; H01R 13/502; H01R 13/5025; H01R 13/506; H01R 13/516; H01R 13/52; H01R 13/5202; H01R 13/521; H01R 13/5213
See application file for complete search history.

(56) References Cited

U.S. PATENT DOCUMENTS

| | | | | |
|---|---|---|---|---|
| 4,342,493 | A * | 8/1982 | Grenell | H01R 13/5213 439/142 |
| 5,573,412 | A * | 11/1996 | Anthony | H01R 13/5213 220/242 |
| 5,800,188 | A * | 9/1998 | Barber | B60D 1/64 220/242 |
| 6,287,136 | B1 * | 9/2001 | Deutsch | H01R 13/213 439/144 |
| 6,469,249 | B2 * | 10/2002 | Capella | H01R 13/447 174/66 |
| 7,972,154 | B2 * | 7/2011 | Pech | H01R 13/625 439/173 |
| 9,276,346 | B1 * | 3/2016 | Czarnecki | H01R 13/447 |
| 9,325,363 | B2 * | 4/2016 | Ferraro | H01R 13/5213 |
| 9,533,586 | B2 * | 1/2017 | Kahara | B60L 11/1818 |

(Continued)

*Primary Examiner* — Amy Cohen Johnson
*Assistant Examiner* — Matthew T Dzierzynski
(74) *Attorney, Agent, or Firm* — Cheng-Ju Chiang

(57) ABSTRACT

A socket connector includes an insulating housing, at least one docking element, a plurality of docking terminals, a fastening board and an outer cover assembly. A middle of the insulating housing has at least one holding groove. The at least one docking element is assembled in the at least one holding groove. The at least one docking element defines a plurality of docking grooves. The plurality of the docking terminals are fastened in the plurality of the docking grooves, separately. The fastening board has a first opening. The insulating housing is fastened to a rear surface of the fastening board. The outer cover assembly is assembled in the first opening. The outer cover assembly includes a frame and a waterproof element. The waterproof element has a sleeving ring, a covering portion, and a connecting element connected between the sleeving ring and the covering portion.

18 Claims, 8 Drawing Sheets

(56) References Cited

U.S. PATENT DOCUMENTS

| | | | | |
|---|---|---|---|---|
| 10,106,109 | B2 * | 10/2018 | Kawai | B60R 16/03 |
| 2012/0312577 | A1 * | 12/2012 | Carbone | H02G 3/088 174/66 |
| 2015/0258905 | A1 * | 9/2015 | Fukushima | H01R 13/506 439/34 |
| 2018/0248275 | A1 * | 8/2018 | Morita | B60L 11/1818 |
| 2019/0047426 | A1 * | 2/2019 | Effenberger | B60L 11/1818 |

* cited by examiner

SOCKET CONNECTOR

BACKGROUND OF THE INVENTION

1. Field of the Invention

The present invention generally relates to an electrical connector, and more particularly to a socket connector of which a structure is firmer and capable of reaching a waterproof function.

2. The Related Art

In recent years, needs of electrical connectors in a wide variety of professions are growing with each passing day, for an electronic machine, a waterproof demand is quite important.

Generally, the electrical connectors are plug connectors or socket connectors. A common socket connector is used in the electronic machine. The common socket connector is used two parts to be assembled in structure, the two parts include a finished product of an outer cover assembly and a finished product of a base. In assembly, the finished product of the base is pressed into and buckled with the finished product of the outer cover assembly by virtue of adopting a common elastic buckling point way, nevertheless, a relative strength of an elastic buckling point of the common socket connector is weaker, so a structure of the common socket connector is apt to be imparted by an external force to cause a damage.

However, the common socket connector needs to be matched with a plug connector in use, when the plug connector is without being inserted into the common socket connector, each interface of the common socket connector is located at an open status that easily causes liquid to enter the common socket connector and further causes a damage of the electronic machine.

Thus, an innovative socket connector is essential to be provided, a structure of the innovative socket connector is firmer and is capable of reaching a waterproof function.

SUMMARY OF THE INVENTION

An object of the present invention is to provide a socket connector. The socket connector includes an insulating housing, at least one docking element, a plurality of docking terminals, a fastening board and an outer cover assembly. The insulating housing has a base holder. A front surface of the base holder protrudes frontward to form a pedestal. A middle of the insulating housing has at least one holding groove longitudinally penetrating through the insulating housing. A peripheral surface of the pedestal is recessed inward towards an inside of the pedestal to form at least one buckling groove. The at least one docking element is assembled in the at least one holding groove. The at least one docking element defines a plurality of docking grooves longitudinally penetrating through a front surface and a rear surface of the at least one docking element. The plurality of the docking terminals are fastened in the plurality of the docking grooves, separately. The fastening board has a first opening. The insulating housing is fastened to a rear surface of the fastening board by virtue of at least one fastening element. The pedestal is assembled in the first opening. The outer cover assembly is assembled in the first opening. The outer cover assembly includes a frame and a waterproof element. The frame has a hollow main body. A peripheral surface of the main body protrudes outward to form a restricting portion projecting beyond the peripheral surface of the main body. A middle of the main body has a second opening longitudinally penetrating through the middle of the main body. A rear surface of the main body protrudes rearward to form at least one buckling portion corresponding to and buckled with the at least one buckling groove. An outer surface of the at least one buckling portion away from the middle of the main body protrudes outward to form a hooking portion hooking the fastening board. The waterproof element has a sleeving ring, a covering portion, and a connecting element connected between the sleeving ring and the covering portion. The sleeving ring is fastened behind the restricting portion and sleeves around the at least one buckling portion. A front surface of the covering portion protrudes frontward to form a fastening block. The covering portion and the fastening block are capable of being folded towards the main body to make the covering portion covered to the main body and make the fastening block project into the second opening of the main body so as to cover the second opening, a middle of the sleeving ring and the first opening. The covering portion and the fastening block are capable of being apart away from the main body so as to expose the second opening, the middle of the sleeving ring and the first opening.

As described above, after the hooking portion of the outer cover assembly is locked to the rear surface of the fastening board in a press-in rotation way, the at least one buckling groove limits the at least one buckling portion so that the outer cover assembly has no way of rotating and is hardly fallen off, in this way, the socket connector is completed being assembled, in addition, water is capable of being prevented from permeating into joints between the fastening board and the outer cover assembly by virtue of increasing the waterproof element of which a material is silicone, when the waterproof element is closed, the socket connector is located at a closed status for preventing the water permeating into the socket connector from the plurality of the docking grooves.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
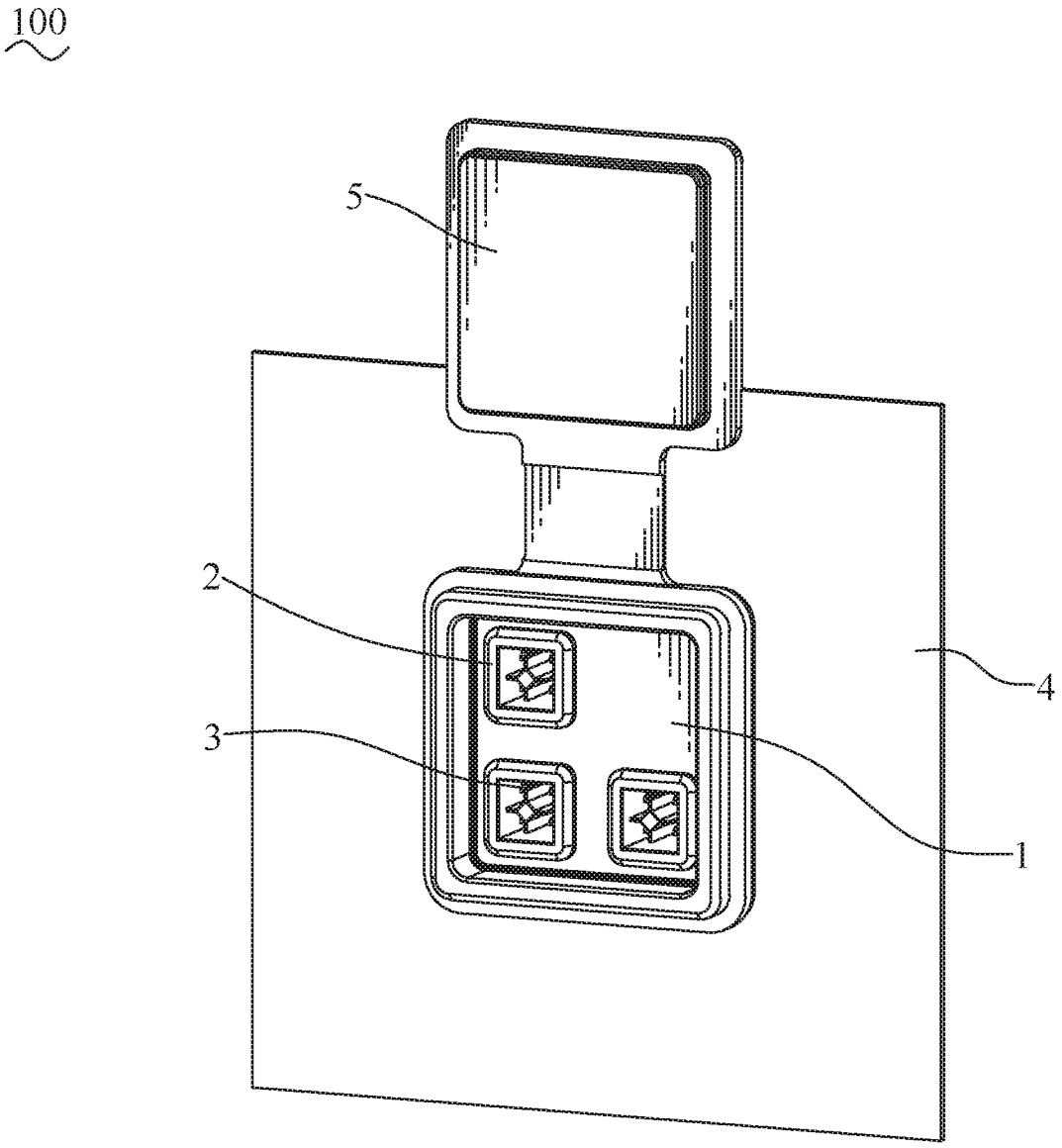
FIG. 1 is a perspective view of a socket connector in accordance with a preferred embodiment of the present invention.
Figure 2:
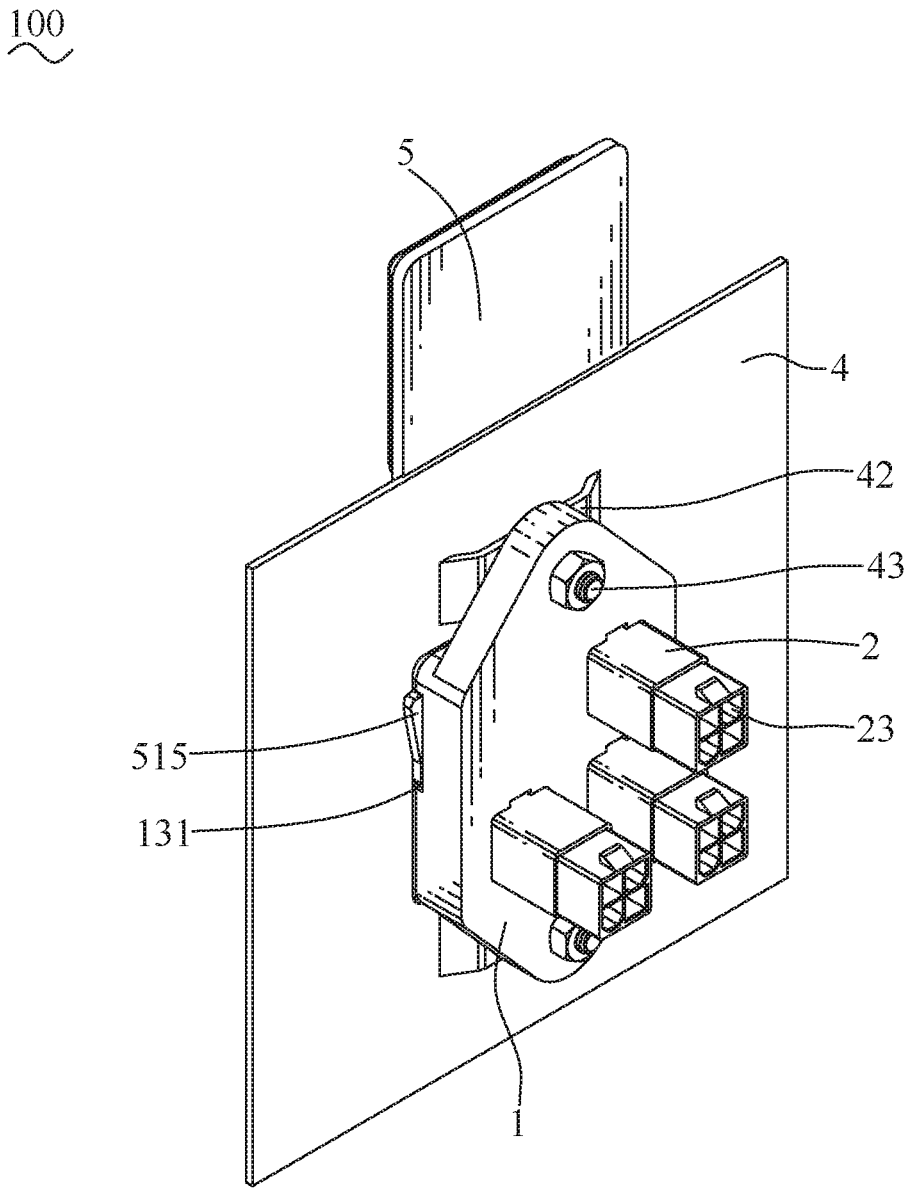
FIG. 2 is another perspective view of the socket connector of FIG. 1.

With reference to FIG. 1 and FIG. 2, a socket connector 100 in accordance with a preferred embodiment of the present invention is shown. The socket connector 100 includes an insulating housing 1, at least one docking element 2, a plurality of docking terminals 3, a fastening board 4 and an outer cover assembly 5.

Figure 3:
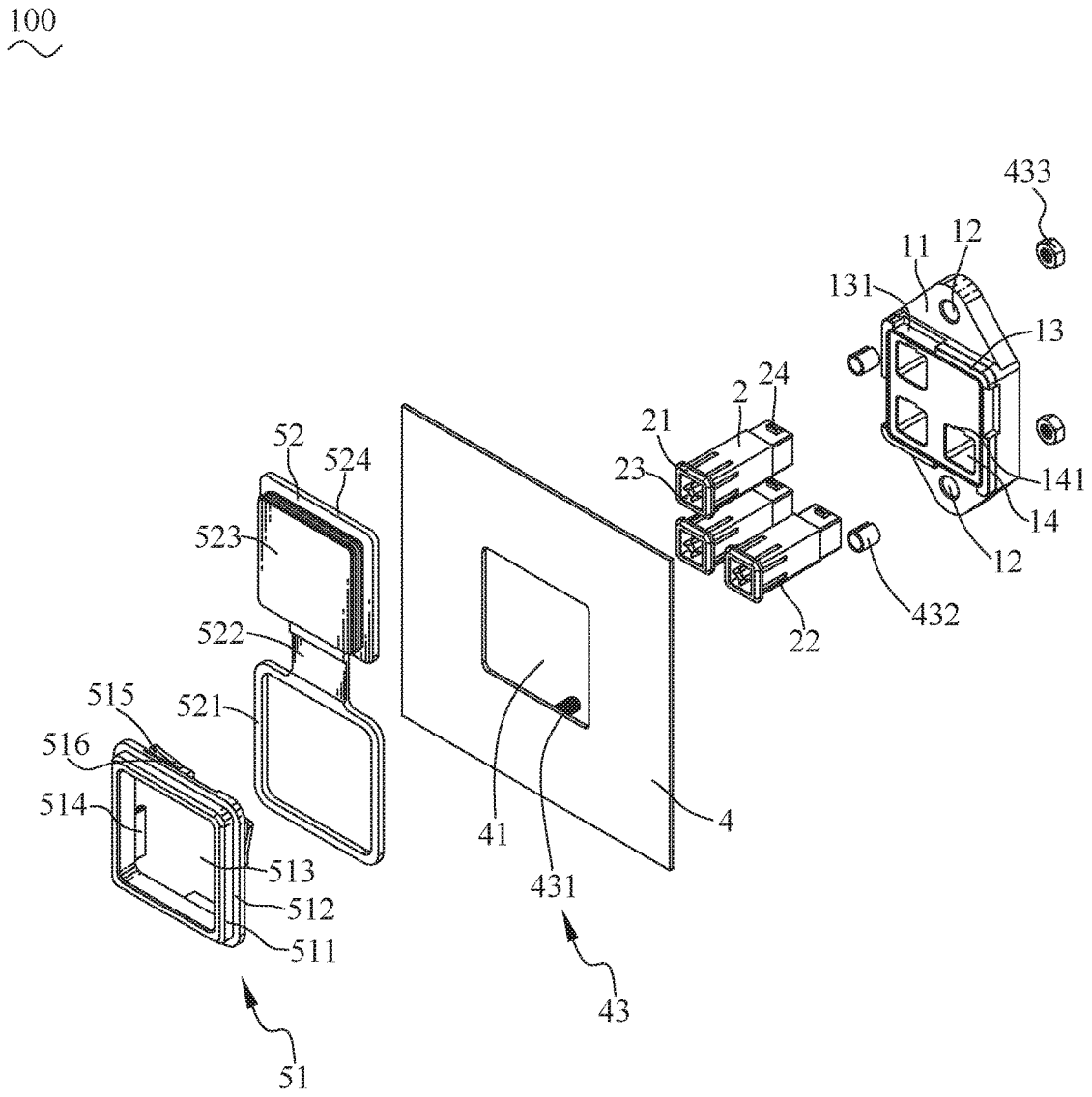
FIG. 3 is an exploded view of the socket connector of FIG. 1.
Figure 4:
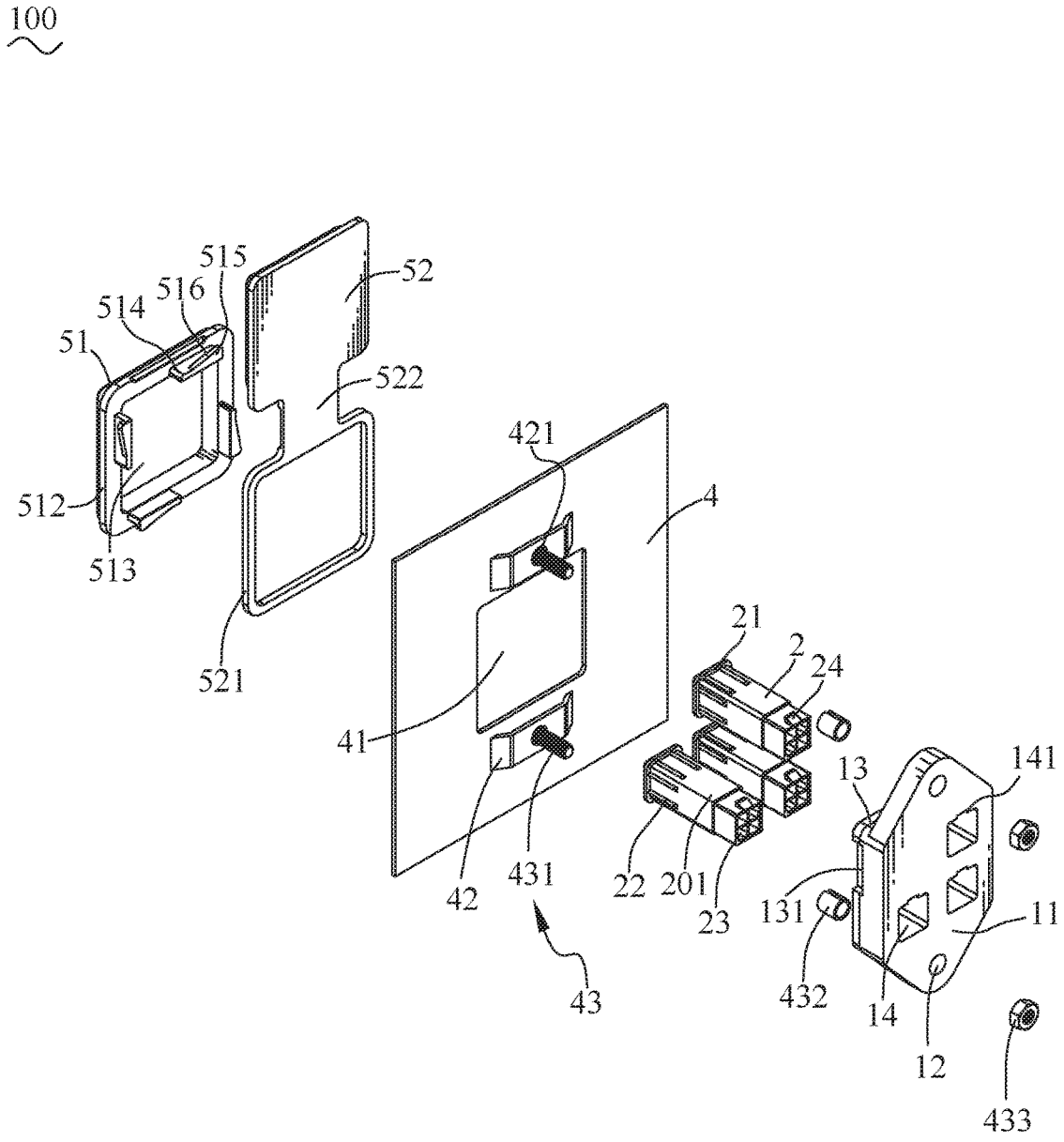
FIG. 4 is another exploded view of the socket connector of FIG. 3.

Referring to FIG. 3 and FIG. 4, the insulating housing 1 has a base holder 11. The base holder 11 opens at least one first fastening hole 12. An upper portion and a lower portion of the base holder 11 open two first fastening holes 12, respectively.

A middle of a front surface of the base holder 11 protrudes frontward to form a pedestal 13. The pedestal 13 is capable of being an arbitrary shape appropriate for the present invention and is without being limited to a shape of the pedestal 13 described in the preferred embodiment of the present invention. At least one side of the insulating housing 1 defines at least one buckling groove 131. In the preferred embodiment, the pedestal 13 is of a cuboid shape. A peripheral surface of the pedestal 13 is recessed inward towards an inside of the pedestal 13 to form the at least one buckling groove 131. Each side surface of the pedestal 13 is recessed inward towards the inside of the pedestal 13 to form a buckling groove 131. A middle of the insulating housing 1 has at least one holding groove 14 longitudinally penetrating through the insulating housing 1. The at least one holding groove 14 penetrates through the pedestal 13 and the base holder 11. A substantial middle of a top of an inner surface of a peripheral wall of the at least one holding groove 14 is recessed upward to form a limiting groove 141.

Referring to FIG. 2, FIG. 3 and FIG. 4, the at least one docking element 2 is assembled in the at least one holding groove 14. A quantity of the at least one docking element 2 is corresponding to a quantity of the at least one holding groove 14. In the preferred embodiment, the socket connector 100 has three holding grooves 14 and three docking elements 2. The at least one docking element 2 is capable of being an arbitrary shape appropriate for the present invention and is without being limited to a shape of the at least one docking element 2 described in the preferred embodiment of the present invention. In the preferred embodiment, the at least one docking element 2 is of a substantially rectangular shape from a top view. The at least one docking element 2 is of a square shape from a front view or a rear view.

The at least one docking element 2 has a base portion 201. A front periphery of the base portion 201 protrudes outward to form a limiting portion 21 projecting beyond a peripheral surface of the base portion 201. Several portions of a front end of the peripheral surface of the base portion 201 protrude outward to form a plurality of protruding ribs 22. The at least one docking element 2 defines a plurality of spaced docking grooves 23 longitudinally penetrating through a front surface and a rear surface of the at least one docking element 2. Specifically, the plurality of the docking grooves 23 longitudinally penetrate through a front surface and a rear surface of the base portion 201. In the preferred embodiment, the at least one docking element 2 defines four spaced docking grooves 23. A top of a rear end of a peripheral surface of the at least one docking element 2 protrudes upward to form a limiting block 24.

Figure 6:
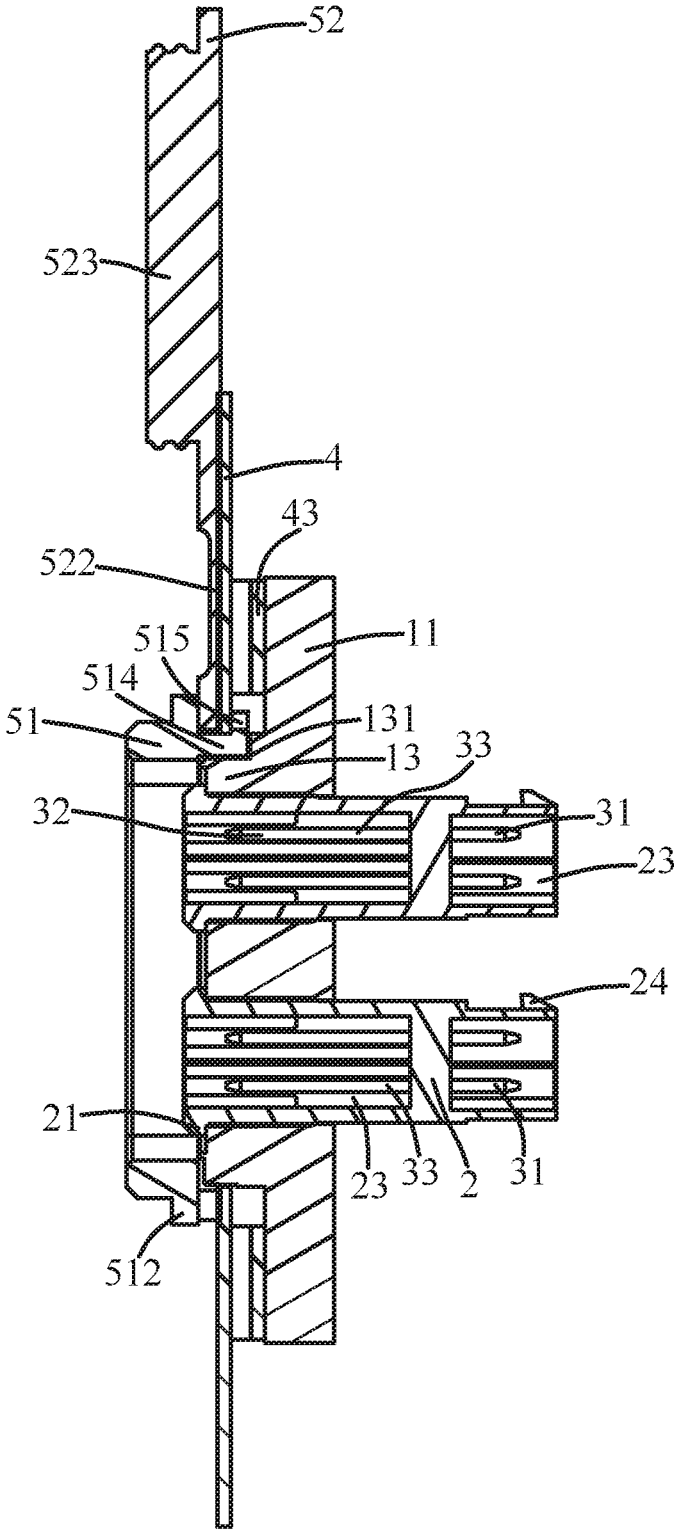
FIG. 6 is a sectional view of the socket connector of FIG. 5.

Referring to FIG. 1 and FIG. 6, the plurality of the docking terminals 3 are fastened in the plurality of the docking grooves 23 separately. Each of the plurality of the docking terminals 3 has a first fastening portion 33, a docking portion 31 extended frontward from a front end of the first fastening portion 33, and a first connection portion 32 extended rearward from a rear end of the first fastening portion 33.

Referring to FIG. 1, FIG. 3 and FIG. 4, the fastening board 4 is sleeved around the pedestal 13. The fastening board 4 has a first opening 41 and is equipped with at least one fastening component 42 corresponding to the at least one first fastening hole 12. The socket connector 100 further includes at least one fastening element 43. The at least one fastening element 43 is fastened to the at least one first fastening hole 12 and the at least one fastening component 42. The at least one fastening component 42 is of an arch shape. A middle of the at least one fastening component 42 opens a second fastening hole 421 corresponding to and connected with the at least one first fastening hole 12. The at least one fastening element 43 is fastened to the second fastening hole 421. The at least one fastening element 43 is an assembly of a screw 431, a bush 432 and a nut 433. The pedestal 13 is assembled in the first opening 41. The bush 432 of the at least one fastening element 43 is disposed in the at least one first fastening hole 12. The screw 431 of the at least one fastening element 43 passes through the at least one first fastening hole 12, the second fastening hole 421 of the at least one fastening component 42 and the bush 432 of the at least one fastening element 43 corresponding to the at least one first fastening hole 12. The screw 431 of the at least one fastening element 43 is screwed in the nut 433 of the at least one fastening element 43.

In the preferred embodiment, the fastening board 4 is equipped with two fastening components 42. One of the two fastening components 42 is disposed above the first opening 41, and the other fastening component 42 is disposed below the first opening 41. Each of the two fastening components 42 is of the arch shape. Middles of the two fastening components 42 open two second fastening holes 421 corresponding to the two first fastening holes 12, respectively. The two fastening components 42 are equipped with two fastening elements 43. The two fastening elements 43 are fastened to the two second fastening holes 421 of the two fastening components 42, respectively. Each of the two fastening elements 43 is capable of being an arbitrary element appropriate for the present invention, and is without being limited to the element described in the preferred embodiment of the present invention. In the preferred embodiment, each of the two fastening elements 43 is the assembly of the screw 431, the bush 432 and the nut 433. The two fastening components 42 are soldered to the fastening board 4. Head portions of the screws 431 of the two fastening elements 43 are fastened to the two fastening components 42.

Referring to FIG. 1, FIG. 3 and FIG. 4, the outer cover assembly 5 is assembled in the first opening 41. The outer cover assembly 5 includes a frame 51 and a waterproof element 52. The frame 51 has a hollow square main body 511. A rear of a peripheral surface of the main body 511 protrudes outward to form a restricting portion 512 projecting beyond the peripheral surface of the main body 511. A middle of the main body 511 has a second opening 513 longitudinally penetrating through the middle of the main body 511. A rear surface of the main body 511 protrudes rearward to form at least one buckling portion 514 corresponding to and buckled with the at least one buckling groove 131. An outer surface of the at least one buckling portion 514 away from the middle of the main body 511 protrudes outward to form a triangle-shaped hooking portion 515. The hooking portion 515 has an inclined side surface 516 slantwise extended from a top to a bottom of the hooking portion 515. The inclined side surface 516 of the hooking portion 515 is slantwise extended from a substantial middle of the outer surface of the at least one buckling portion 514 away from the middle of the main body 511. Specifically, each rear side surface of the main body 511 protrudes rearward to form a buckling portion 514 corresponding to and buckled with the buckling groove 131. An outer surface of the buckling portion 514 away from the middle of the main body 511 protrudes outward to form the triangle-shaped hooking portion 515.

A material of the waterproof element 52 is silicone. The water is capable of being prevented from permeating into joints between the fastening board 4 and the outer cover assembly 5 by virtue of increasing the waterproof element 52 of which the material is the silicone. The waterproof element 52 is adhered to a rear of the frame 51. In the preferred embodiment, the waterproof element 52 is adhered to the rear of the frame 51 by virtue of a double faced adhesive tape (not shown). The waterproof element 52 has a sleeving ring 521, a covering portion 524, and a connecting element 522 connected between the sleeving ring 521 and the covering portion 524. The connecting element 522 is extended upward from a middle of a top of the sleeving ring 521. A top of the connecting element 522 extends upward and then expands transversely and oppositely to form the covering portion 524. A middle of a front surface of the covering portion 524 protrudes frontward to form a fastening block 523. The sleeving ring 521 is fastened behind the restricting portion 512. The sleeving ring 521 sleeves around the at least one buckling portion 514 of the main body 511. The sleeving ring 521 is fastened to the at least one buckling portion 514 of the main body 511 by virtue of the hooking portion 515. The sleeving ring 521 is clamped between the restricting portion 512 and the hooking portion 515. A rear surface of the sleeving ring 521 is spaced from the hooking portion 515.

The connecting element 522 is capable of bending to make the covering portion 524 covered to the main body 511 and make the fastening block 523 project into the second opening 513 so as to close the waterproof element 52, and the connecting element 522 is capable of being disposed vertically to make the covering portion 524 together with the fastening block 523 apart away from a middle of the sleeving ring 521 and the main body 511 so as to open the waterproof element 52 and make the waterproof element 52 disposed vertically. The covering portion 524 and the fastening block 523 are capable of being folded towards the main body 511 to make the covering portion 524 covered to the main body 511 and make the fastening block 523 project into the second opening 513 of the main body 511 so as to cover the second opening 513, the middle of the sleeving ring 521 and the first opening 41. The covering portion 524 and the fastening block 523 are capable of being apart away from the main body 511 so as to expose the second opening 513, the middle of the sleeving ring 521 and the first opening 41.

Figure 8:
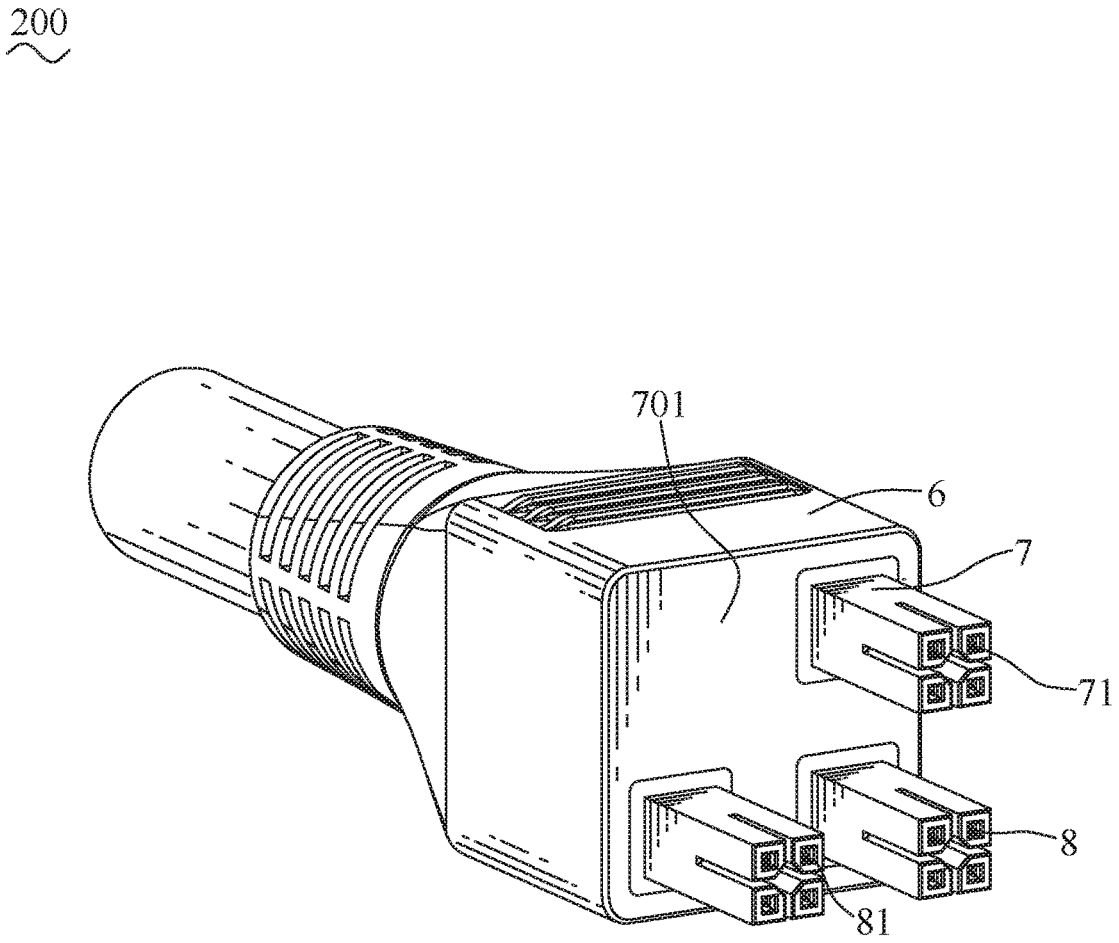
FIG. 8 is a perspective view of a plug connector matched with the socket connector in accordance with the present invention.

Referring to FIG. 8, the socket connector 100 is matched with a plug connector 200. The plug connector 200 includes a dielectric body 6, at least one insertion element 7 and a plurality of insertion terminals 8. The at least one insertion element 7 is assembled to the dielectric body 6 and is exposed out of the dielectric body 6. A quantity of the at least one insertion element 7 is corresponding to a quantity of the at least one docking element 2. In the preferred embodiment, the socket connector 100 includes three docking elements 2. The plug connector 200 includes three insertion elements 7. The at least one insertion element 7 is capable of being an arbitrary shape appropriate for the present invention and is without being limited to a shape of the at least one insertion element 7 described in the preferred embodiment of the present invention. In the preferred embodiment, the at least one insertion element 7 is of a cuboid shape. The at least one insertion element 7 has a plurality of insertion grooves 71 penetrating through a docking surface 701 of the at least one insertion element 7. The plurality of the insertion terminals 8 are fastened to the plurality of the insertion grooves 71. Each of the plurality of the insertion terminals 8 has a second fastening portion (not shown), a second insertion portion 81 extended frontward from a front end of the second fastening portion, and a second connection portion (not shown) extended rearward from a rear end of the second fastening portion.

Figure 5:
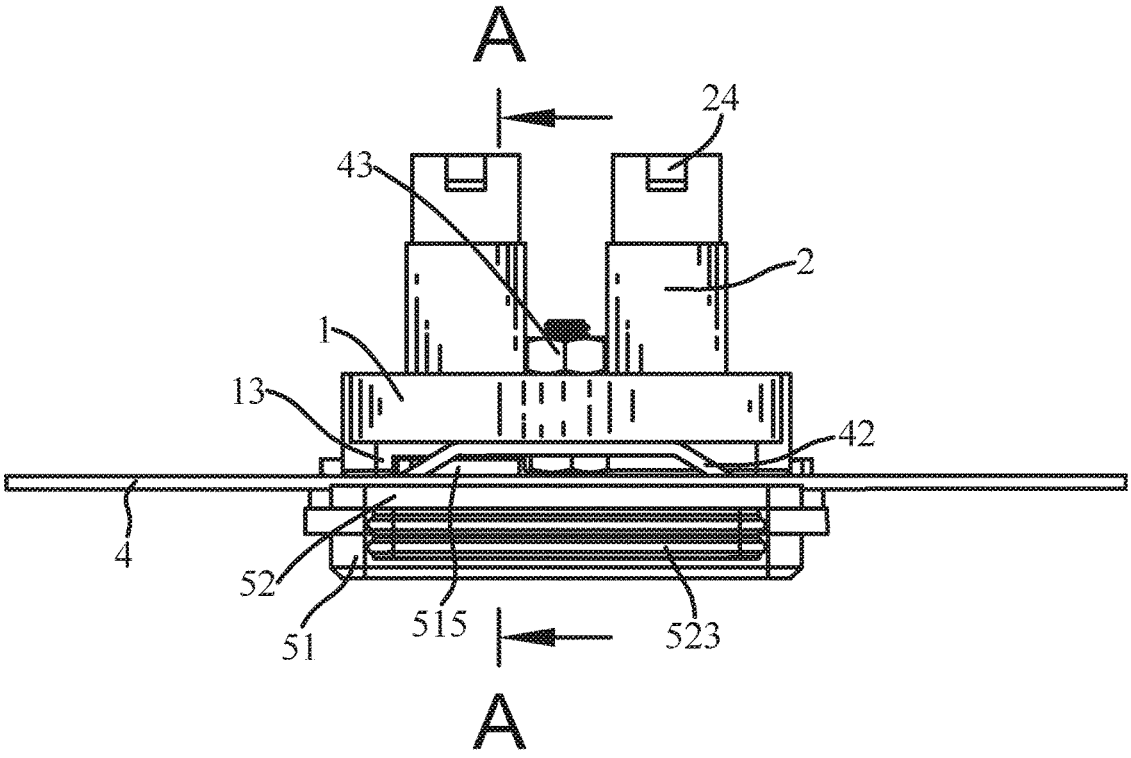
FIG. 5 is a top view of the socket connector of FIG. 1.

Referring to FIG. 4 to FIG. 6, when the socket connector 100 is assembled, the outer cover assembly 5 rotates by an angle and in a rotation direction to make the hooking portion 515 of the main body 511 pass through the first opening 41, and then the outer cover assembly 5 rotates in a reverse direction opposite to the rotation direction to return to an original position, at the moment, an inner peripheral wall of the fastening board 4 is clamped between the hooking portion 515 and the rear surface of the sleeving ring 521, the hooking portion 515 hooks the fastening board 4, so that the hooking portion 515 of the outer cover assembly 5 is locked to and fastened to a rear surface of the fastening board 4 in a press-in rotation way. The outer cover assembly 5 is assembled to the fastening board 4 in the press-in rotation way so that water is capable of being prevented from permeating into the joints between the fastening board 4 and the outer cover assembly 5, at the moment, the main body 511 is located at a front surface of the fastening board 4.

Referring to FIG. 4 to FIG. 6, each of the plurality of the docking terminals 3 is fastened in one of the plurality of the docking grooves 23. The docking portions 31 of the plurality of the docking terminals 3 are exposed to front ends of the plurality of the docking grooves 23. The first fastening portions 33 of the plurality of the docking terminals 3 are fastened in the plurality of the docking grooves 23. The first connection portions 32 of the plurality of the docking terminals 3 are exposed to rear ends of the plurality of the docking grooves 23. When the at least one docking element 2 is assembled in the at least one holding groove 14. The limiting block 24 passes through the limiting groove 141 in advance. When the at least one docking element 2 keeps being pushed to a bottom of the at least one holding groove 14, the limiting portion 21 blocks a front surface of the peripheral wall of the at least one holding groove 14 to make the at least one docking element 2 have no way of completely passing through the limiting groove 141, at the moment, the plurality of the protruding ribs 22 are disposed in the at least one holding groove 14 and contact inner side walls of the at least one holding groove 14 for increasing friction forces to make the at least one docking element 2 fastened in the at least one holding groove 14. A tail end of the at least one docking element 2 is exposed out from a rear end of the at least one holding groove 14, and an inner periphery of the rear end of the at least one holding groove 14 is coated with glue, after the glue is solidified, the at least one docking element 2 may be prevented from being pulled out.

The bushes 432 of the two fastening elements 43 are disposed in the two first fastening holes 12, respectively. The base holder 11 is disposed to the rear surface of the fastening board 4, at the moment, the two first fastening holes 12 are connected with the two second fastening holes 421 of the two fastening components 42. At the same time, the screw 431 of each of the two fastening elements 43 passes through one of the two first fastening holes 12, one of the two second fastening holes 421 and the bush 432 of one of the two fastening elements 43 corresponding to the one of the two first fastening holes 12. Then the screw 431 of each of the two fastening elements 43 is screwed in the nut 433 of the one of the two fastening elements 43, so that the insulating housing 1 is fastened to the rear surface of the fastening board 4 by virtue of the at least one fastening element 43, at the moment, the at least one buckling portion 514 is disposed in the at least one buckling groove 131, and the at least one buckling groove 131 limits the at least one buckling portion 514 so that the outer cover assembly 5 has no way of rotating and is hardly fallen off, in this way, the socket connector 100 is completed being assembled.

Figure 7:
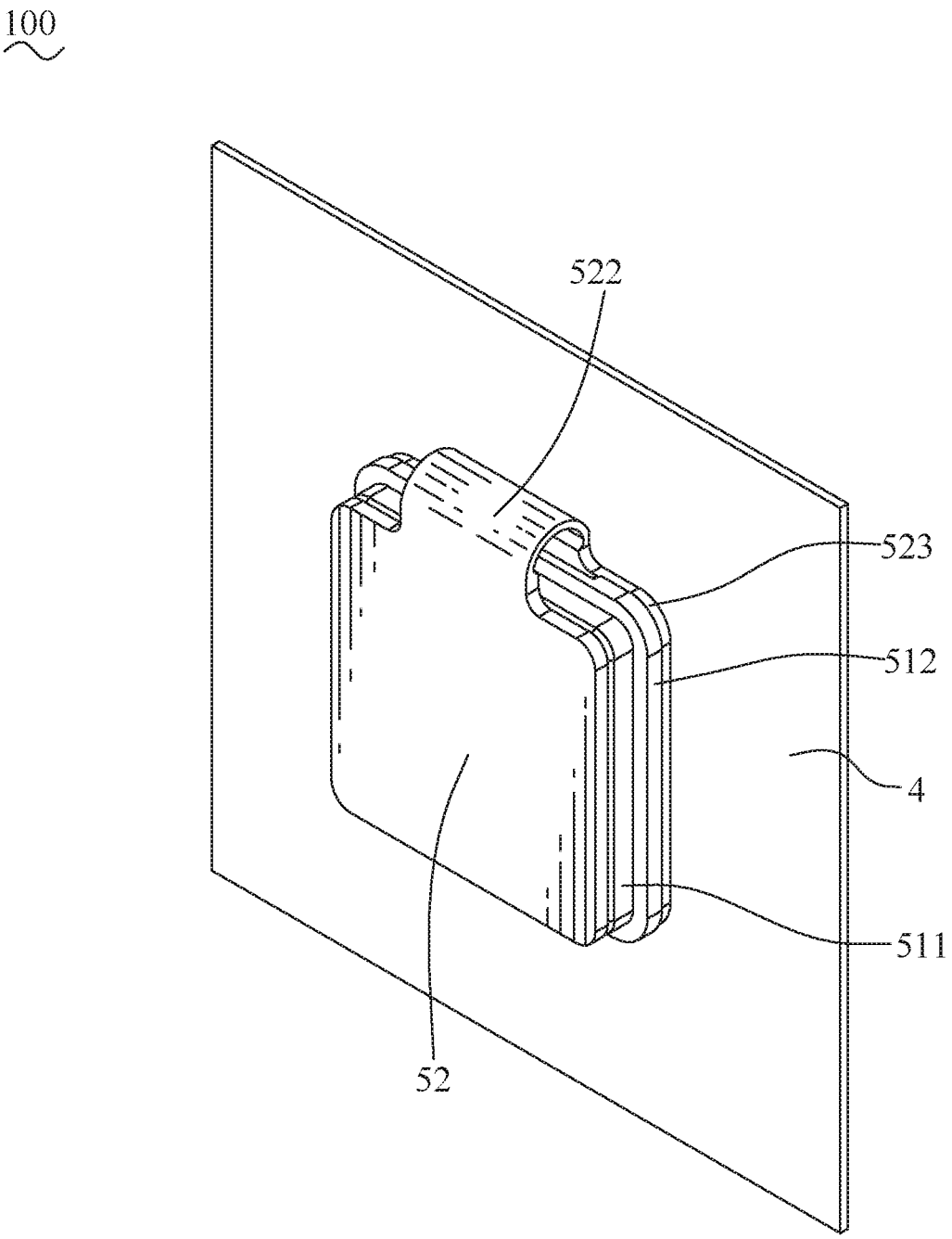
FIG. 7 is a perspective view of the socket connector in accordance with the present invention, wherein the socket connector is in a closed status.

Referring to FIG. 1 and FIG. 7, the waterproof element 52 has the connecting element 522 capable of bending or being disposed vertically to make the waterproof element 52 be able to be folded or opened. When the socket connector 100 is unused, the fastening block 523 of the waterproof element 52 is assembled in the second opening 513 to make the waterproof element 52 closed and each of the plurality of the docking grooves 23 is isolated from an outside, so that when the waterproof element 52 is closed, the socket connector 100 is located at a closed status for preventing the water permeating into the socket connector 100 from the plurality of the docking grooves 23. When the socket connector 100 is in use, the fastening block 523 of the waterproof element 52 is withdrawn from the second opening 513, so that the plurality of the docking grooves 23 are located at opening statuses.

When the plug connector 200 is assembled, the plurality of the insertion terminals 8 are disposed in the plurality of insertion grooves 71, separately. Then the at least one insertion element 7 is fastened to the dielectric body 6.

When the plug connector 200 is assembled with the socket connector 100, the at least one insertion element 7 is inserted into the at least one docking element 2 so as to complete a connection between the plug connector 200 and the socket connector 100. When the plug connector 200 is withdrawn from the socket connector 100, the at least one insertion element 7 is withdrawn from the at least one docking element 2, so that a separation between the plug connector 200 and the socket connector 100 is completed.

As described above, after the hooking portion 515 of the outer cover assembly 5 is locked to the rear surface of the fastening board 4 in the press-in rotation way, the at least one buckling groove 131 limits the at least one buckling portion 514 so that the outer cover assembly 5 has no way of rotating and is hardly fallen off, in this way, the socket connector 100 is completed being assembled, in addition, the water is capable of being prevented from permeating into the joints between the fastening board 4 and the outer cover assembly 5 by virtue of increasing the waterproof element 52 of which the material is the silicone, when the waterproof element 52 is closed, the socket connector 100 is located at the closed status for preventing the water permeating into the socket connector 100 from the plurality of the docking grooves 23.

What is claimed is:

1. A socket connector, comprising:

an insulating housing having a base holder, a front surface of the base holder protruding frontward to form a pedestal, a middle of the insulating housing having at least one holding groove longitudinally penetrating through the insulating housing, a peripheral surface of the pedestal being recessed inward towards an inside of the pedestal to form at least one buckling groove;

at least one docking element assembled in the at least one holding groove, the at least one docking element defining a plurality of docking grooves longitudinally penetrating through a front surface and a rear surface of the at least one docking element;

a plurality of docking terminals fastened in the plurality of the docking grooves, separately;

a fastening board having a first opening, the insulating housing being fastened to a rear surface of the fastening board by virtue of at least one fastening element, the pedestal being assembled in the first opening; and an outer cover assembly assembled in the first opening, the outer cover assembly including a frame and a waterproof element, the frame having a hollow main body, a peripheral surface of the main body protruding outward to form a restricting portion projecting beyond the peripheral surface of the main body, a middle of the main body having a second opening longitudinally penetrating through the middle of the main body, a rear surface of the main body protruding rearward to form at least one buckling portion corresponding to and buckled with the at least one buckling groove, an outer surface of the at least one buckling portion away from the middle of the main body protruding outward to form a hooking portion hooking the fastening board, the waterproof element having a sleeving ring, a covering portion, and a connecting element connected between the sleeving ring and the covering portion, the sleeving ring fastened behind the restricting portion and sleeving around the at least one buckling portion, a front surface of the covering portion protruding frontward to form a fastening block;

wherein the covering portion and the fastening block are capable of being folded towards the main body to make the covering portion covered to the main body and make the fastening block project into the second opening of the main body so as to cover the second opening, a middle of the sleeving ring and the first opening, the covering portion and the fastening block are capable of being apart away from the main body so as to expose the second opening, the middle of the sleeving ring and the first opening.

2. The socket connector as claimed in claim 1, wherein the connecting element is capable of bending to make the covering portion covered to the main body and make the fastening block project into the second opening so as to close the waterproof element, and the connecting element is capable of being disposed vertically to make the covering portion together with the fastening block apart away from the middle of the sleeving ring and the main body so as to open the waterproof element and make the waterproof element disposed vertically.

3. The socket connector as claimed in claim 1, wherein the base holder opens at least one first fastening hole, the at least one fastening element is fastened to the at least one first fastening hole.

4. The socket connector as claimed in claim 3, wherein the fastening board is equipped with at least one fastening component corresponding to the at least one first fastening hole, the at least one fastening element is fastened to the at least one fastening component.

5. The socket connector as claimed in claim 4, wherein the at least one fastening component is of an arch shape, a middle of the at least one fastening component opens a second fastening hole, the at least one fastening element is fastened to the second fastening hole.

6. The socket connector as claimed in claim 5, wherein the at least one fastening element is an assembly of a screw, a bush and a nut, the bush of the at least one fastening element is disposed in the at least one first fastening hole, the screw of the at least one fastening element passes through the at least one first fastening hole, the second fastening hole of the at least one fastening component and the bush of the at least one fastening element corresponding to the at least one first fastening hole, the screw of the at least one fastening element is screwed in the nut of the at least one fastening element.

7. The socket connector as claimed in claim 1, wherein an upper portion and a lower portion of the base holder open two first fastening holes, respectively, the fastening board is equipped with two fastening components, the two fastening components are equipped with two fastening elements disposed in the two first fastening holes, respectively.

8. The socket connector as claimed in claim 7, wherein one of the two fastening components is disposed above the first opening, and the other fastening component is disposed below the first opening.

9. The socket connector as claimed in claim 7, wherein middles of the two fastening components open two second fastening holes corresponding to the two first fastening holes, respectively, the two fastening elements are fastened to the two second fastening holes, respectively.

10. The socket connector as claimed in claim 9, wherein each of the two fastening elements is an assembly of a screw, a bush and a nut, the bushes of the two fastening elements are disposed in the two first fastening holes, respectively, the screw of each of the two fastening elements passes through one of the two first fastening holes, one of the two second fastening holes and the bush of one of the two fastening elements corresponding to the one of the two first fastening holes, the screw of each of the two fastening elements is screwed in the nut of the one of the two fastening elements.

11. The socket connector as claimed in claim 7, wherein each of the two fastening components is of an arch shape.

12. The socket connector as claimed in claim 1, wherein the hooking portion has an inclined side surface slantwise extended from a top to a bottom of the hooking portion.

13. The socket connector as claimed in claim 1, wherein a material of the waterproof element is silicone.

14. The socket connector as claimed in claim 1, wherein a substantial middle of a top of an inner surface of a peripheral wall of the at least one holding groove is recessed upward to form a limiting groove, a top of a rear end of a peripheral surface of the at least one docking element protrudes upward to form a limiting block, the limiting block passes through the limiting groove.

15. The socket connector as claimed in claim 1, wherein the waterproof element is adhered to a rear of the frame.

16. The socket connector as claimed in claim 1, wherein the at least one docking element has a base portion, a front periphery of the base portion protrudes outward to form a limiting portion projecting beyond a peripheral surface of the base portion, the limiting portion blocks a front surface of a peripheral wall of the at least one holding groove.

17. The socket connector as claimed in claim 16, wherein several portions of a front end of the peripheral surface of the base portion protrude outward to form a plurality of protruding ribs, the plurality of the protruding ribs are disposed in the at least one holding groove and contact inner side walls of the at least one holding groove.

18. The socket connector as claimed in claim 1, wherein the connecting element is extended upward from a middle of a top of the sleeving ring, a top of the connecting element extends upward and then expands transversely and oppositely to form the covering portion.

* * * * *